US009656459B2

(12) United States Patent
Kuwabara et al.

(10) Patent No.: US 9,656,459 B2
(45) Date of Patent: May 23, 2017

(54) INK JET RECORDING METHOD

(71) Applicant: CANON KABUSHIKI KAISHA, Tokyo (JP)

(72) Inventors: Nobuyuki Kuwabara, Hachioji (JP); Fumihiro Goto, Kawasaki (JP); Masaki Nitta, Yokohama (JP); Keiichirou Takeuchi, Komae (JP); Kanako Soma, Yokohama (JP); Takao Ogata, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/188,915

(22) Filed: Jun. 21, 2016

(65) Prior Publication Data

US 2017/0008273 A1 Jan. 12, 2017

(30) Foreign Application Priority Data

Jul. 10, 2015 (JP) ..... 2015-138672

(51) Int. Cl.
*B41J 2/15* (2006.01)
*B41J 2/005* (2006.01)
*B41J 11/00* (2006.01)

(52) U.S. Cl.
CPC ..... *B41J 2/0057* (2013.01); *B41J 11/0015* (2013.01)

(58) Field of Classification Search
CPC ..... B41J 2/0057; B41J 2002/012; B41J 2/01; B41J 11/002; B41J 11/0015; B41J 2/005; B41J 2/07; B41J 2/2114
See application file for complete search history.

(56) References Cited

U.S. PATENT DOCUMENTS 5,231,425 A 7/1993 Masuda et al.
5,459,981 A 10/1995 Masuda et al.
(Continued)

FOREIGN PATENT DOCUMENTS

JP 2005-343049 A 12/2005

OTHER PUBLICATIONS

U.S. Appl. No. 15/097,547, filed Apr. 13, 2016. Inventor: Kanako Soma, et al.

(Continued)

*Primary Examiner* — Lamson Nguyen
(74) *Attorney, Agent, or Firm* — Fitzpatrick, Cella, Harper & Scinto

(57) ABSTRACT

An ink jet recording method of transferring onto a recording medium an intermediate image formed on an intermediate transfer member by an ink jet technique to record an image on the recording medium, the method including a pretreatment agent applying step of applying a pretreatment agent onto an intermediate transfer member; an ink applying step of applying an ink by an ink jet technique onto a region of the intermediate transfer member onto which the pretreatment agent is applied, thereby forming an intermediate image; a transfer step of transferring the intermediate image formed on the intermediate transfer member onto a recording medium; and a selection controlling step of controlling selection of execution or non-execution of at least one of the pretreatment agent applying step and the transfer step, based on an amount of the ink applied onto the intermediate transfer member.

11 Claims, 11 Drawing Sheets

(56) References Cited

U.S. PATENT DOCUMENTS

| | | | | |
|---|---|---|---|---|
| 5,617,122 | A | 4/1997 | Numata et al. | |
| 5,975,673 | A | 11/1999 | Ohtsuka et al. | |
| 5,981,045 | A | 11/1999 | Kuwabara et al. | |
| 5,992,968 | A | 11/1999 | Uetsuki et al. | |
| 5,992,971 | A | 11/1999 | Takahashi et al. | |
| 6,318,853 | B1 | 11/2001 | Asano et al. | |
| 6,394,571 | B1 | 5/2002 | Yano et al. | |
| 6,422,696 | B1 | 7/2002 | Takahashi et al. | |
| 6,565,183 | B2 | 5/2003 | Goto et al. | |
| 6,601,952 | B2 | 8/2003 | Sugioka et al. | |
| 6,860,578 | B2 | 3/2005 | Yamada et al. | |
| 6,991,327 | B2 | 1/2006 | Goto et al. | |
| 7,125,095 | B2 | 10/2006 | Yamada et al. | |
| 7,367,643 | B2 | 5/2008 | Furuichi et al. | |
| 7,396,098 | B2 | 7/2008 | Kanematsu et al. | |
| 7,419,257 | B2 | 9/2008 | Mouri et al. | |
| 7,773,244 | B2 | 8/2010 | Yano et al. | |
| 7,798,593 | B2 | 9/2010 | Nitta et al. | |
| 7,880,910 | B2 | 2/2011 | Aichi et al. | |
| 7,961,345 | B2 | 6/2011 | Yano et al. | |
| 8,174,711 | B2 | 5/2012 | Yano et al. | |
| 8,197,050 | B2 | 6/2012 | Takekoshi et al. | |
| 8,203,741 | B2 | 6/2012 | Yano et al. | |
| 8,395,802 | B2 | 3/2013 | Yano et al. | |
| 8,870,358 | B2 * | 10/2014 | Okuda | C09D 11/40 347/100 |
| 9,010,915 | B2 * | 4/2015 | Usui | B41J 2/175 347/100 |
| 9,039,157 | B2 | 5/2015 | Ogata et al. | |
| 9,068,090 | B2 * | 6/2015 | Gotou | B41J 2/2107 |
| 9,340,050 | B2 | 5/2016 | Otani et al. | |
| 9,389,824 | B2 | 7/2016 | Yano et al. | |
| 2003/0222985 | A1 | 12/2003 | Goto et al. | |
| 2005/0110856 | A1 | 5/2005 | Mouri et al. | |
| 2011/0298853 | A1 | 12/2011 | Takamiya et al. | |
| 2014/0176630 | A1 | 6/2014 | Takeuchi et al. | |

OTHER PUBLICATIONS

European Search Report dated Feb. 8, 2017 in European Application No. 16177452.6.

* cited by examiner

INK JET RECORDING METHOD

BACKGROUND OF THE INVENTION

Field of the Invention

The present invention relates to a transfer image recording method using an ink jet technique.

Description of the Related Art

In recent years, an ink jet recording method is often employed as an image recording method for outputting, for example, an image produced by a computer or a copy image of printed matter. A printer using an ink jet recording method has various advantages, such as unnecessity of a complicated device configuration, low noise, small running costs, and easiness in size reduction and color printing. The printer using an ink jet recording method has flexibility in size of recording media to which the printer is applicable, from a business card size to a large poster size, and has attracted attention in industrial use. For these reasons, such printers using an ink jet recording method have been on the market with those having small sizes at relatively low costs, and thus, are suitably used as printing machines for, for example, personal computers and digital cameras. An ink jet recording method is applied not only to printers but also to output devices of office automation equipment, such as facsimile machines and copiers, and printing equipment.

As a mainstream application of an ink jet recording method, ink is directly applied onto a recording medium such as paper, fabrics, or plastic sheets based on an image signal so that a character or an image, for example, is printed on the recording medium. Since the ink jet recording method does not need a printing plate, even a small number of printed sheets can be effectively produced. Thus, the ink jet recording method is hopefully expected to be applied to industrial printing. In the application to industrial printing, however, usable recording media might be limited in some cases.

A cause of the limitation in applying the method to recording media is ink absorbency of the recording media. Ink used in the ink jet recording method is in a liquid state at room temperature, and a difference in absorption permeability to ink among recording media can affect the image quality. In particular, in a recording medium having no liquid absorbency and a recording medium having low liquid absorbency, such a phenomena as a bleeding phenomenon in which adjacent ink droplets are mixed and a beading phenomenon in which previously impacted ink droplets are attracted to subsequently impacted ink droplets often occur. In the case of a recording medium having low liquid absorbency, in addition to bleeding and beading, a phenomenon called feathering in which ink permeates the recording medium along fibers therein so that ink is blurred can occur. On the other hand, when liquid absorbency of a recording medium is enhanced, the problems described above are reduced, but ink reaches the back surface of the recording medium so that so-called strike-through of an image can occur. In addition, in the case of using an ink having a high moisture content for a recording medium including cellulose fibers and having high liquid absorbency, a cockling phenomenon in which bonds in cellulose constituting fibers in the recording medium are broken so that flatness of the recording medium is impaired.

As a recording method for solving such problems, there is proposed a transfer recording method employing a transfer technique in which an ink image formed on an intermediate transfer member is transferred onto a recording medium by an external force such as a pressure. In the transfer recording method, first, an ink image is temporarily formed on the intermediate transfer member by an ink jet recording method, and the viscosity of the ink image on the intermediate transfer member is increased together with drying of the ink, or a solvent of the ink image is removed so that the ink is condensed, thereby forming an intermediate image. Thereafter, the ink-applied surface of the intermediate transfer member is superimposed on the recording medium so that a pressure and/or heat acts from an ink-nonapplied surface of the intermediate transfer member, and thereby, the intermediate image is transferred onto the recording medium. In the transfer recording method, ink is not directly applied onto the recording medium, but is applied onto the intermediate transfer member. Thus, neither feathering nor cockling occurs in the intermediate transfer member. Thus, this method is effective for prevention of feathering and cockling occurring in association with a permeation behavior of a liquid ink into the recording medium.

As a recording medium used for color image formation by ink jet recording, plain paper used for an electrophotographic copier or other equipment is often used, in addition to dedicated recording sheets for ink jet. This plain paper is produced by a large number of manufacturers, and thus, even white paper slightly differs in paper quality and color tone among manufacturers. In conventional image formation by ink jet recording, a white part in an image is expressed by a base color of a white recording medium. In recent years, however, since the color tone differs among manufacturers as described above, a white ink has been employed. For example, Japanese Patent Application Laid-Open No. 2005-343049 discloses an ink jet recording device including a first white ink applying means and a second white ink applying means. The first white ink applying means is a means for applying a white ink onto an intermediate transfer member. The second white ink applying means is a means for applying a white ink onto a recording medium before a transfer operation. In this manner, the white ink is applied onto the recording medium by the second white ink applying means, then an image is formed by using a color ink, and then, an intermediate transfer member onto which the white ink has been applied by the first white ink applying means is superimposed on the image so that transfer is performed. In this manner, in the case of using the white ink described above, the transfer recording method can obtain advantages similar to those obtained in the case of using an ink of a color except white described above.

In addition, another technique is proposed for enhancing glossiness of an image by covering an image with a smooth transparent coating in a case where a user wishes to express an image formed on a recording medium as a photo-like image. For such a technique, a transparent ink including no coloring materials has been applied. This transparent ink is applicable not only to a direct recording method but also to a transfer image recording method.

SUMMARY OF THE INVENTION

An ink jet recording method according to the present invention is an ink jet recording method of transferring onto a recording medium an intermediate image formed on an intermediate transfer member by an ink jet technique to record an image on the recording medium, the method including:

(1) a pretreatment agent applying step of applying a pretreatment agent onto an intermediate transfer member;

(2) an ink applying step of applying an ink by an ink jet technique onto a region of the intermediate transfer member onto which the pretreatment agent is applied, thereby forming an intermediate image;

(3) a transfer step of transferring the intermediate image formed on the intermediate transfer member onto a recording medium; and (4) a selection controlling step of controlling selection of execution or non-execution of at least one of the pretreatment agent applying step and the transfer step, based on an amount of the ink applied onto the intermediate transfer member.

According to the present invention, in a case where an image that needs an overlay of, for example, a white ink layer and a transparent ink layer is transferred from an intermediate transfer member onto a recording medium and a transfer operation needs to be performed multiple times on the same portion of the recording medium, the number of transfer operations can be reduced to a number less than the number of layers. This configuration can suppress a decrease in useful life of the intermediate transfer member which is an exchangeable member.

Further features of the present invention will become apparent from the following description of exemplary embodiments with reference to the attached drawings.

BRIEF DESCRIPTION OF THE DRAWINGS

FIG. 2A illustrates a preparatory stage of the pretreatment agent application, and FIG. 2B illustrates a state at the start of the pretreatment agent application.

FIG. 3A illustrates a state in which first ink application and drying are performed, and FIG. 3B illustrates a state in which the transfer operation is not executed after the ink application.

FIG. 4A illustrates a state at the start of the transfer operation, and FIG. 4B illustrates a state at the end of the transfer operation.

FIG. 5A illustrates a first transfer operation, and FIG. 5B schematically illustrates a multi-layer structure of ink layers of an image formed on the recording medium after the end of a fourth transfer operation.

FIG. 6A is a flowchart of an ejection signal conversion of a color ink, and FIG. 6B is a flowchart of an ejection signal conversion of a white ink and a transparent ink.

DESCRIPTION OF THE EMBODIMENTS

Figure 1:
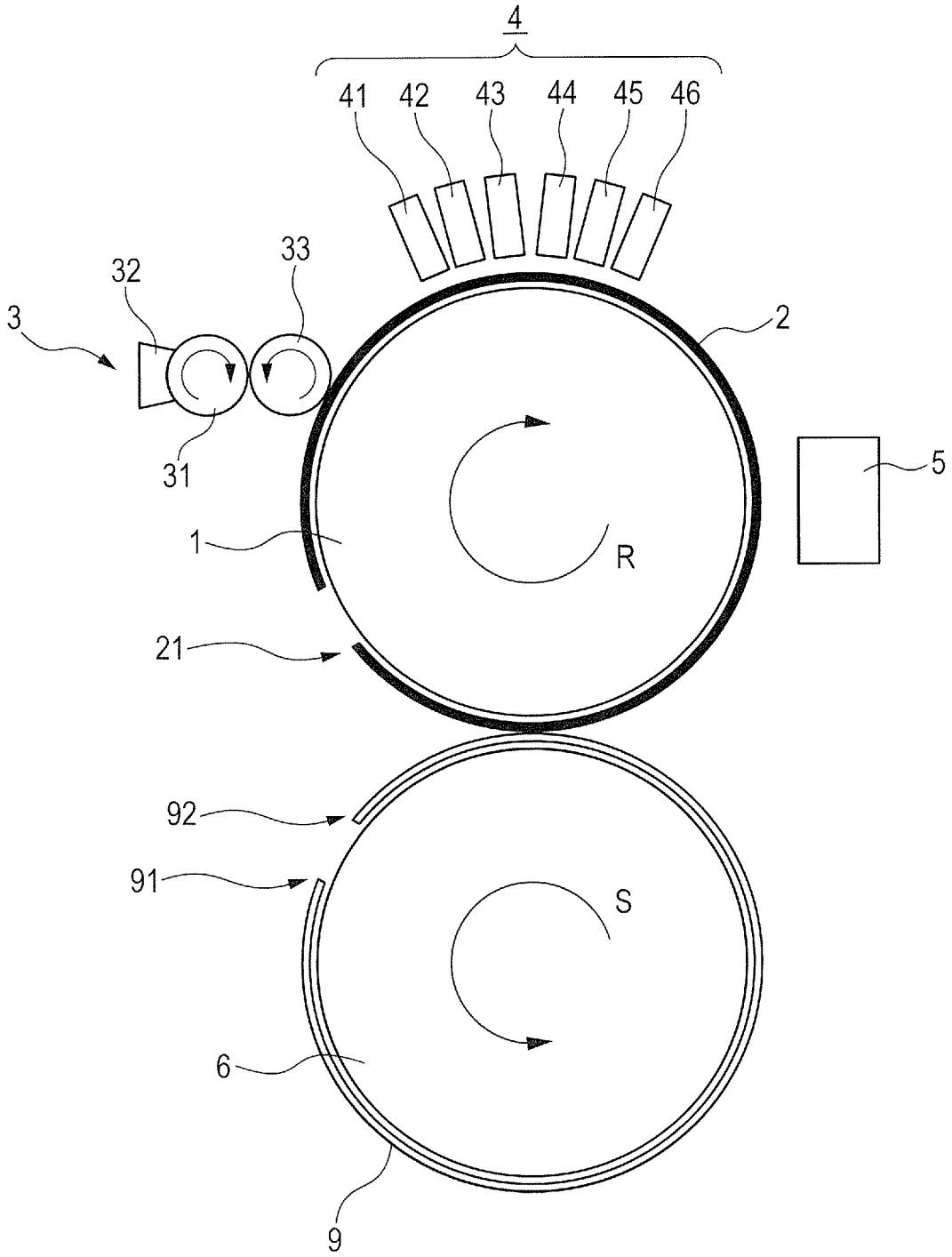
FIG. 1 is a schematic view illustrating a configuration of a recording device using an ink jet recording method according to the present invention.

Preferred embodiments of the present invention will now be described in detail in accordance with the accompanying drawings.

To form a more favorable image by using a white ink or a transparent ink, the amounts of these inks often need to be larger than that of a color ink in application. In particular, in the case of using a transparent ink, to enhance glossiness of an image, a layer of the transparent ink is overlaid on an image formed by using a color ink, and such an outermost layer is preferably smooth. In the image formed by using the color ink, however, a plurality of color inks are used in different amounts, and thus, the ink applied surfaces fail to have high smoothness in some cases. Thus, to satisfy requirements for the surface smoothness, the image surface formed by using the color ink needs to be covered with the transparent ink in a sufficient amount larger than that of the applied color ink. On the other hand, in the case of using a white ink, to sufficiently express a whiteness degree, concealability of an underlying color needs to be enhanced, and accordingly, the amount of the white ink to be applied needs to be larger than the amount of the applied color ink.

In addition, demands for decorative printing to change textures by providing surface unevenness to an image formed on a recording medium have been increasing. For example, for a portion of the recording medium on which a user wants to form surface projection by using a transparent ink, the amount of an applied transparent ink needs to be larger than those for the other portions.

To achieve such image expression with a transfer technique, the amount of a transparent ink or a white ink applied onto an intermediate transfer member needs to be larger than that of a normal color ink. Many ink jet recording devices employ a method for suppressing displacement of impact positions among colors by forming images of a plurality of colors with one scanning with a plurality of recording heads arranged nearby. Thus, the total amount of the ink that can be applied onto a recording medium is already determined, and there is a limitation in forming a plurality of layers of ink with one scanning. In view of this, to apply a large amount of a transparent ink or a white ink, an application operation is repeated multiple times, that is, an ink is applied in a plurality of layers.

Consequently, the applied ink layers become thick, and a pressure or thermal energy for transfer needs to be enhanced in order to cause transfer energy to act on the ink sufficiently. The transfer operation performed by using one intermediate transfer member, however, is not finished at one time, but is performed repeatedly. In consideration of durability of an intermediate transfer member to repetitive use, the pressure and thermal energy cannot be increased infinitely. Thus, the maximum amount of the ink that can be transferred from the intermediate transfer member onto a recording medium can be limited in some cases.

In the case of forming an image that requires an amount of the ink exceeding the upper limit of the amount of the ink that can be transferred from the intermediate transfer member to the recording medium, a transfer operation is performed on the same portion of the recording medium multiple times so that the amount of the ink transferred at one transfer operation can be reduced to be the upper limit described above or less. Performing the transfer operation on the same portion of the recording medium multiple times, however, increases the number of transfer operations to a number equal to the number of recorded sheets or more. As a result, a problem of a decrease in useful life of the intermediate transfer member can arise.

In the device disclosed in Japanese Patent Application Laid-Open No. 2005-343049, white ink layers are divided into a part on the intermediate transfer member and a part on the recording medium, and thus, the amount of the white ink applied onto the intermediate transfer member can be reduced. Japanese Patent Application Laid-Open No. 2005-343049, however, discloses neither the upper limit of the amount of an ink that can be transferred from an intermediate transfer member onto a recording medium defined in consideration of durability of the intermediate transfer member nor a reduction of the number of transfer operations in forming a plurality of ink layers constituting an image.

The present invention has an object of providing a transfer ink jet recording method that can suppress a decrease in useful life of an intermediate transfer member in the case of transferring a plurality of ink layers including a white ink layer and a transparent ink layer onto the same portion of a recording medium, by determining whether a transfer operation is executed or not for each of the ink layers and reducing the number of transfer operations to below the number of ink layers.

An ink jet recording method according to the present invention is a transfer ink jet recording method including the following steps:

(1) a pretreatment agent applying step of applying a pretreatment agent onto an intermediate transfer member;

(2) an ink applying step of applying an ink by an ink jet technique onto a region of the intermediate transfer member onto which the pretreatment agent is applied, thereby forming an intermediate image;

(3) a transfer step of transferring the intermediate image formed on the intermediate transfer member onto a recording medium; and (4) a selection controlling step of controlling selection of execution or non-execution of at least one of the pretreatment agent applying step and the transfer step, based on an amount of the ink applied onto the intermediate transfer member.

If the transfer step is not executed, the pretreatment agent applying step is not executed and the ink applying step is executed again so that the amount of the applied ink for forming the intermediate image can be increased. The ink applying step is executed again as described above, which can be repeated until the total amount of the ink applied onto the intermediate transfer member reaches a prescribed value. An ink used at each time of the ink applying steps can be selected for each time in accordance with a target intermediate image.

The total amount of the ink to be applied onto the intermediate transfer member may be obtained from the amount of the ink ejected from the ink jet head. As the total ink amount, a value obtained from an estimated amount of the ink ejected from the ink jet head calculated from image data may be used. The ink jet recording method according to the present invention may have a first recording mode of executing the pretreatment agent applying step and the transfer step and a second recording mode of controlling selection of execution or non-execution of each of the pretreatment agent applying step and the transfer step. These modes may be selected in accordance with purposes.

A step set including the steps (1) to (4) may be performed multiple times, and intermediate images obtained in the step sets may be sequentially transferred onto an identical image forming surface of the recording medium to form a final image. In addition, these step sets are individually performed on different regions of the intermediate transfer member. Then, the number of transfer operations can be reduced. At this time, the different regions may be substantially evenly disposed on the intermediate transfer member. Then, the number of transfer operations can be efficiently reduced.

The ink may include a white ink, a transparent ink, and a color ink of a color except white, the white ink and the transparent ink may be allocated to the step sets in such a manner that the amount of application of each of the white ink and the transparent ink is larger than that of the color ink, and in forming an intermediate image including the color ink on the intermediate transfer member and transferring the intermediate image onto the recording medium, the total amount of the ink in forming the intermediate image including the color ink may be less than the prescribed value.

At least one of the following configurations may be employed so that the white ink and the transparent ink, which are used in larger amounts than that of the color ink, can be efficiently applied onto the intermediate transfer member.

- The amount of the ejected droplet in applying at least one of the white ink or the transparent ink onto the intermediate transfer member is larger than that of the color ink.
- The ejection frequency of an ink jet head for applying at least one of the white ink and the transparent ink onto the intermediate transfer member is higher than an ejection frequency of an ink jet head for applying the color ink.
- The number of ink jet heads for at least one the white ink and the transparent ink is larger than the number of ink jet heads for the color ink. In the case of using color inks of a plurality of colors, at least one of the number of ink jet heads for the white ink or the number of ink jet heads for the transparent ink is larger than the number of ink jet heads for each of the color inks.

The present invention will be described in detail with reference to the drawings.

Configuration and Operation of Ink Jet Recording Device

FIG. 1 schematically illustrates an operation principle of a recording device using an ink jet recording method according to the present invention.

A transfer ink jet recording device illustrated in FIG. 1 includes a transfer drum 1 and an intermediate transfer member 2 disposed at the outer periphery of the transfer drum 1. The intermediate transfer member 2 has a surface having no liquid permeability and having a mold releasing property, and is attached to the transfer drum 1 with a double face tape, in a manner similar to a blanket of a normal printing machine. The transfer drum 1 is supported by an unillustrated shaft, and is configured to be rotatably driven by an unillustrated drum driving device at a constant speed in the direction indicated by the arrow R. A pretreatment agent applying unit 3 first applies a pretreatment agent onto the entire surface of the intermediate transfer member 2.

Next, an ink jet head group 4 is used to apply ink onto the intermediate transfer member 2 coated with the pretreatment agent, thereby causing the pretreatment agent and the ink to react with each other to form an image of the viscosity-increased-ink, that is, an intermediate image. When the transfer drum 1 further rotates, the intermediate image passes through a location where a hot air dryer 5 is disposed. The hot air dryer 5 performs warm air drying to evaporate moisture in the intermediate image.

In addition, a recording medium conveying drum 6 having the same diameter as that of the transfer drum 1 is disposed at a location opposing to the transfer drum 1. A recording medium 9 onto which the intermediate image subjected to the warm air drying is to be transferred is disposed at the outer periphery of the recording medium conveying drum 6 by using a holding mechanism. The recording medium conveying drum 6 is supported by an unillustrated shaft, and is configured to be rotatably driven by an unillustrated drum driving device at constant speed in the direction indicated by the arrow S and of a speed equal to that of the transfer drum 1.

Then, the transfer drum 1 and the recording medium conveying drum 6 abut on each other at a specific point to form a nip part, and the intermediate image is transferred onto the recording medium 9. The intermediate transfer member 2 that has finished the transfer therefrom has consumed all the ink for forming the intermediate image, and thus, is used for next image transfer again in a series of steps starting from the pretreatment agent applying unit 3.

The pretreatment agent applying unit 3, the ink jet head group 4, and the hot air dryer 5 provided in this recording device will be sequentially described in detail.

Pretreatment Agent Applying Unit

The pretreatment agent applying unit 3 provides a coating of the pretreatment agent with rotation of the transfer drum 1 in the following manner:

When the transfer drum 1 rotates in the direction indicated by the arrow R, a leading portion 21 of the intermediate transfer member 2 first approaches the pretreatment agent applying unit 3. A liquid pretreatment agent is supplied to a doctor chamber 32 from an unillustrated pretreatment agent supplying unit. Then, while a cell of a rotating anilox roller 31 is charged with the pretreatment agent by a doctor blade (not shown) in the doctor chamber 32, a redundant portion of the pretreatment agent is scraped off so that a constant amount of the pretreatment agent is retained in the cell. Thereafter, the pretreatment agent is moved from the cell of the anilox roller 31 onto an offset roller 33 that is in contact with the anilox roller 31 to slave-rotate, and the pretreatment agent is made uniform as a thin liquid film on the offset roller 33. The surface of the offset roller 33 is made of a rubber material such as ethylene-propylene-diene rubber (EPDM), and is also in contact with the intermediate transfer member 2. At this contact point, a pretreatment liquid is transferred onto the surface of the intermediate transfer member 2 while maintaining a uniform coating thickness.

Image Drawing Part

Then, the intermediate transfer member 2 onto which the pretreatment agent has been transferred moves to an image drawing part constituted by the ink jet head group 4. The ink jet head group 4 is in a form in which six ink jet heads are evenly spaced in a direction in which the intermediate transfer member 2 moves. Inks are applied from the corresponding ink jet heads so that an intermediate image is formed on the surface of the intermediate transfer member 2. Ink jet heads 41 to 46 eject a black ink, a yellow ink, a magenta ink, a cyan ink, a white ink, and a transparent ink containing no coloring materials, respectively. As the transparent ink, an ink having a function of enhancing adhesion between the ink and the recording medium in transfer is used. A combination of color inks except the white ink is not limited to a combination of the black ink, the yellow ink, the magenta ink, and the cyan ink, and may be any combination in accordance with a target image.

The ink jet heads 41 to 46 used herein are so-called line heads having a nozzle array length larger than the width of the intermediate transfer member (dimension in the direction orthogonal to the moving direction). The positions of these line heads are fixed when applying ink so that ink can be ejected to the entire image formation region in association with conveyance of the intermediate transfer member 2. Accordingly, the relatively heavy line heads do not need to be moved, and the intermediate transfer member only needs to be conveyed in one direction. Thus, these heads can be used for high-speed image formation. Alternatively, so-called shuttle heads that apply ink while scanning the intermediate transfer member in a width direction may be used for ink application. In performing higher-speed image formation, however, line heads are preferable.

Color Ink and White Ink

The color inks including the black ink, the yellow ink, the magenta ink, and the cyan ink contain dispersed resin particles in addition to pigment particles as a coloring material. On the other hand, the pretreatment agent contains an organic acid as a component for aggregating pigment particles and resin particles in the color inks and resin particles in the transparent ink. Contact between the pretreatment agent and the ink applied to the intermediate transfer member 2 causes a component in the pretreatment agent to promptly react with pigment particles and resin particles in the ink so that the pigment particles and the resin particles aggregate. Similarly, the transparent ink contains dispersed resin particles, and contact between the pretreatment agent and the transparent ink causes an organic acid in the pretreatment agent to promptly react with resin particles in the ink so that the resin particles aggregate. Here, an organic acid is employed as a reactant of the pretreatment agent. Alternatively, any material may be employed as long as the material has a function of aggregating pigment particles and resin particles, such as a polyvalent metal salt and a cationic polymer.

Examples of the ink include an ink containing a liquid medium, a coloring material, and an aggregation component to react with the pretreatment agent and having a composition necessary for forming an intermediate image to be transferred onto a recording medium. Examples of the coloring material include a dye, carbon black, and a pigment such as an organic pigment expressed by the color index (C.I.) number. Various types of color inks for ink-jetting in which a coloring material is dissolved and/or dispersed in a liquid medium may also be used.

Examples of the coloring material for the white ink include titanium dioxide.

The content of the coloring material in the ink is 0.5% by mass or more to 15.0% by mass or less, with respect to the total mass of the ink.

Among components contained in the ink, a pigment as a coloring material and resin particles can be used as a component for promoting aggregation caused by the pretreatment agent. The pigment and the resin particles may be selected according to purposes from known materials used in combination with the pretreatment agent, such as those of a self-dispersible type, a type to be dispersed by a dispersant, e.g. water-soluble resins.

Examples of a material for the resin particles include homopolymers, such as polyolefin, polystyrene, polyurethane, polyester, polyether, polyurea, polyamide, polyvinyl alcohol, poly(meth)acrylic acid and a salt thereof, poly (meth)alkyl acrylate, and polydiene, and copolymers as a combination of at least two of these homopolymers.

The amount of resin particles in the ink can be 1% by mass or more to 50% by mass or less, with respect to the total mass of the ink.

The resin particles are fine particles having a dispersion particle diameter of preferably 10 nm or more to 1000 nm or less, and more preferably 100 nm or more to 500 nm or less.

As the liquid medium for the ink, water and/or an organic solvent can be used. For an ink jet technique, an aqueous pigment ink using an aqueous liquid medium as a liquid medium is preferable.

Examples of the aqueous liquid medium include water or a mixture of water and a water-soluble organic solvent. Water is preferably deionized by, for example, ion exchange. The content of water in the aqueous pigment ink is preferably 30% by mass or more to 97% by mass or less, with respect to the total mass of the aqueous pigment ink.

The type of the water-soluble organic solvent is not specifically limited as long as the water-soluble organic solvent can be used for ink jet ink. Specifically, examples of the water-soluble organic solvent include glycerin, diethylene glycol, polyethylene glycol, and 2-pyrrolidone. At least one of these water-soluble organic solvents can be used. The content of the water-soluble organic solvent in the aqueous pigment ink is preferably 3% by mass or more to 70% by mass or less, with respect to the total mass of the aqueous pigment ink.

Based on these conditions, an ink having the following composition was prepared.

Black Ink

An ink having the following composition was prepared as a black ink. The unit "%" is based on mass.

| | |
|---|---|
| Carbon black | 3.0% |
| Styrene-acrylic acid-ethyl acrylate-copolymer (acid value: 240, weight average molecular weight: 5000) | 1.0% |
| Glycerin | 10.0% |
| Ethylene glycol | 5.0% |
| Nonionic surfactant | 0.5% |
| Water | balance |

Yellow Ink

An ink prepared by changing the coloring material used in the black ink from carbon black to pigment yellow 74 was used as a yellow ink.

Magenta Ink

An ink prepared by changing the coloring material used in the black ink from carbon black to pigment red 7 was used as a magenta ink.

Cyan Ink

An ink prepared by changing the coloring material used in the black ink from carbon black to pigment blue 15 was used as a cyan ink.

White Ink

An ink prepared by changing the coloring material used in the black ink from carbon black to titanium dioxide was used as a white ink.

Pretreatment Agent

The pretreatment agent contains a component that increases the viscosity of an ink to be applied onto an intermediate transfer member by causing aggregation of an aggregation component in the ink. The increase of the ink viscosity herein refers not only to a case where a viscosity increase in the entire ink is observed when a coloring material, a resin, or the like in the ink comes into contact with an ink-viscosity-increasing component to cause chemical reaction or physical adsorption but also to a case where a local viscosity increase occurs due to aggregation of part of components such as a coloring material in the ink.

As a component of the pretreatment agent, components that can cause target aggregation by increasing the ink viscosity, such as polyvalent metal ions, an organic acid, a cationic polymer, and porous fine particles, can be selectively used. The content of the component for causing agglomeration in the pretreatment agent is preferably 5% by mass or more, with respect to the total mass of the reaction liquid.

Examples of metal ions that can be used as a component of the pretreatment agent for causing aggregation include bivalent metal ions, such as $Ca^{2+}$, $Cu^{2+}$, $Ni^{2+}$, $Mg^{2+}$, $Sr^{2+}$, $Ba^{2+}$, and $Zn^{2+}$, and trivalent metal ions, such as $Fe^{3+}$, $Cr^{3+}$, $Y^{3+}$, and $Al^{3+}$.

Examples of the organic acid that can be used as a component of the pretreatment agent for causing aggregation include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidonecarboxylic acid, pyronecarboxylic acid, pyrrolecarboxylic acid, furancarboxylic acid, pyridinecarboxylic acid, coumalic acid, thiophenecarboxylic acid, nicotinic acid, oxysuccinic acid, and dioxysuccinic acid.

The pretreatment agent may contain an appropriate amount of water and an organic solvent.

Based on these conditions, a pretreatment agent having the following composition was prepared. The unit "%" is based on mass.

| | |
|---|---|
| Citric acid | 30.0% |
| Glycerin | 15.0% |
| Nonionic surfactant | 1.0% |
| Water | balance |

Transparent Ink

The transparent ink can be used for forming an adhesive layer in transferring an intermediate image onto a recording medium or a glossiness imparting layer for imparting glossiness to an image. The transparent ink may be any ink as long as the ink is transparent enough to have no influence on an image formed by using a white ink or a color ink of a color except white. Thus, the ratio of a maximum absorbance to a minimum absorbance (maximum absorbance/minimum absorbance) of a first liquid composition in a wave range of visible light from 400 nm to 800 nm is preferably 1.0 or more to 2.0 or less. This means that the composition has substantially no peak in absorbance or, even when the composition has a peak in absorbance, this peak has an extremely low intensity in the wavelength range of visible light. In addition, the transparent ink preferably contains no coloring materials. The absorbance can be measured with Hitachi Double Beam Spectrophotometer U-2900 (manufactured by Hitachi High-Technologies Corporation), by using an undiluted liquid transparent ink. The absorbance may be measured by using a liquid transparent ink diluted with a solvent that does not affect measurement of the absorbance. This is because both the maximum absorbance and the minimum absorbance of the liquid transparent ink are proportional to a dilution ratio, and thus, the ratio of the maximum absorbance to the minimum absorbance (maximum absorbance/minimum absorbance) does not depend on dilution ratio.

In this example, a transparent ink having the following composition was used. The unit "%" is based on a mass.

Resin particle dispersion (20% prepared solution) 50.0% (material type: butyl methacrylate, particle diameter: about 100 nm, weight average molecular weight: about one hundred thousand)

| | |
|---|---|
| Glycerin | 5.0% |
| Diethylene glycol | 7.0% |
| Nonionic surfactant | 0.5% |
| Water | balance |

Drying Unit

The intermediate transfer member 2 on which the intermediate image is formed is still moved to a drying unit constituted by the hot air dryer 5. The hot air dryer 5 has a capacity of sending warm air at about 80° C. at 5 m/sec, and evaporates mainly water from the intermediate image formed on the intermediate transfer member 2.

The hot air dryer 5 incorporates a halogen heater (not shown) as a heat source and an air-sending fan (not shown) and can remove a most part of moisture in the ink in a short time. The method for removing moisture is not limited to the configuration of this embodiment, and other known methods such as an infrared (IR) heater may be used.

Transfer Unit

At a point where a region of the intermediate transfer member 2 including an intermediate image from which most part of moisture has been removed by the hot air dryer 5 passes the hot air dryer 5 in association with rotation of the transfer drum 1, the transfer drum 1 and the recording medium conveying drum 6 abut on each other under a constant pressure, thereby forming a nip part. Rotations of the drums at constant speeds cause intermediate images formed on the intermediate transfer member 2 to be sequentially inserted in the nip part from the front end to the rear end in the moving direction of the intermediate transfer member 2, and sequentially transferred onto the recording medium 9.

In association with transmission of an image recording signal, the recording medium 9 is sent to the recording medium conveying drum 6 through an unillustrated paper feed mechanism, and then is fixed with a holding mechanism disposed in the recording medium conveying drum 6. The holding mechanism has a configuration in which a holding part 91 which is an upstream end of the recording medium 9 in a conveying direction and a holding end part 92 which is a downstream end in the conveying direction are fixed with holding claws (not shown). The holding claws is released from the recording medium 9 on which image formation by a transfer operation has been finished, and the recording medium 9 is delivered to the outside of the recording device by a paper delivery mechanism (not shown).

The transfer unit 6 has a mechanism that moves the shaft supporting the recording medium conveying drum 6 by a predetermined distance in the vertical direction in FIG. 1 so that abutting on and alienation from the transfer drum 1 can be performed. This operation enables control of execution or non-execution of the transfer step.

Formation of Drawing Data

In the foregoing description concerning the image drawing part, the intermediate image is formed on the surface of the intermediate transfer member 2 by applying an ink from the ink jet head group 4. A signal used in ejecting the ink from each ink jet head will now be described.

When an image signal for obtaining a final image to be formed on a recording medium is sent to the recording device, this signal is first converted to an ejection signal of each ink jet head in the recording device. This process will be described with reference to the flowcharts of FIGS. 6A and 6B.

Figure 6A:
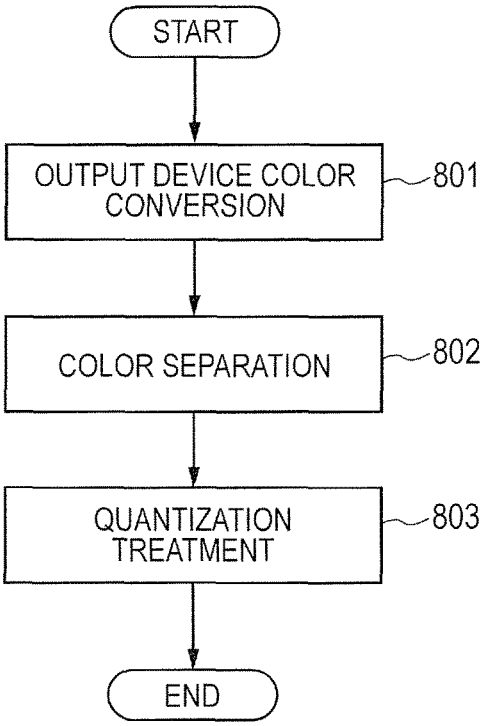
FIGS. 6A and 6B are flowcharts of procedures of determining the amounts of ejected inks based on input image data.

The input image data is constituted by standard RGB data representing a color image, data representing the amount of the white ink, and data representing the amount of the transparent ink. Among these types of data, as the RGB data representing a color image, as illustrated in FIG. 6A, at step 801, data on a color space of a standard color is converted to signal data specific to an output device. Then, at step 802, the signal data specific to the output device is converted to ink color data used in the recording device, such as cyan, magenta, yellow, and black. At step 802, data of colors is generated in such a manner that the amount of an ink does not exceed the total amount of the ink that can be used for recording on the recording medium at a time, and it is ensured that a non-defective intermediate image is formed on the intermediate transfer member 2. In addition, at step 803, conversion to the number of levels that can be used for recording is performed. For example, in the case of binary expression of putting an ink dot and not putting an ink dot, binarization is performed by a quantization technique such as error diffusion. In this manner, a recordable data format can be obtained, and an image is formed based on the data format.

Figure 6B:
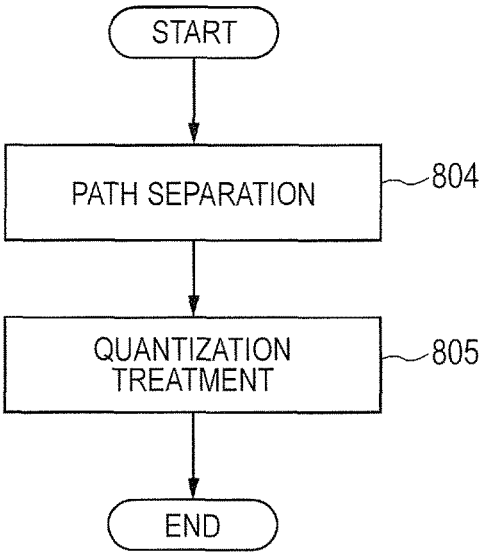

On the other hand, data representing the amounts of the white ink and the transparent ink indicates the amounts of the inks for each pixel, as illustrated in FIG. 6B. At step 804, the number of recording operations with 100% is separated from data of recording less than 100%. The data of recording less than 100% is subjected to quantization treatment at step 805. With this process, the maximum transfer number in transfer is determined.

EXAMPLES

The present invention will be specifically described using examples.

Example 1

In the description of the flow of steps with reference to FIG. 1 and FIGS. 6A and 6B, each of the pretreatment liquid applying unit 3 and the recording medium conveying drum 6 includes unillustrated alienation mechanisms for alienating the transfer drum 1 to control abutting on or alienation from (contact or noncontact) the intermediate transfer member 2 as intended. In other words, selection of execution or non-execution of an operation is controlled. Then, operation control using these alienation mechanisms according to the present invention will be described.

Figure 5A:
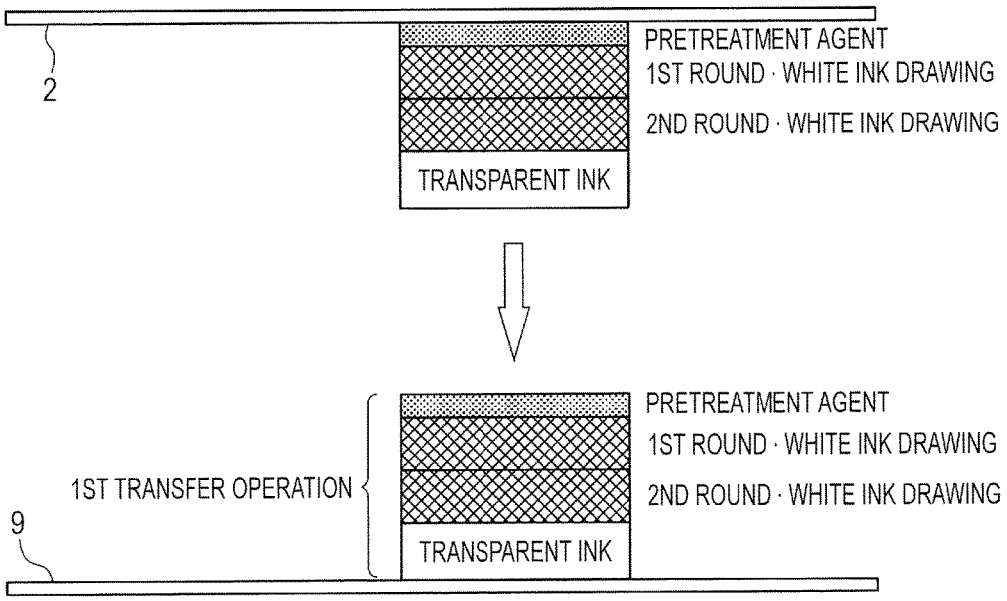
FIGS. 5A and 5B illustrate a state of ink layers of an image formed on a recording medium by using the ink jet recording method according to the present invention and a transfer procedure.
Figure 5B:
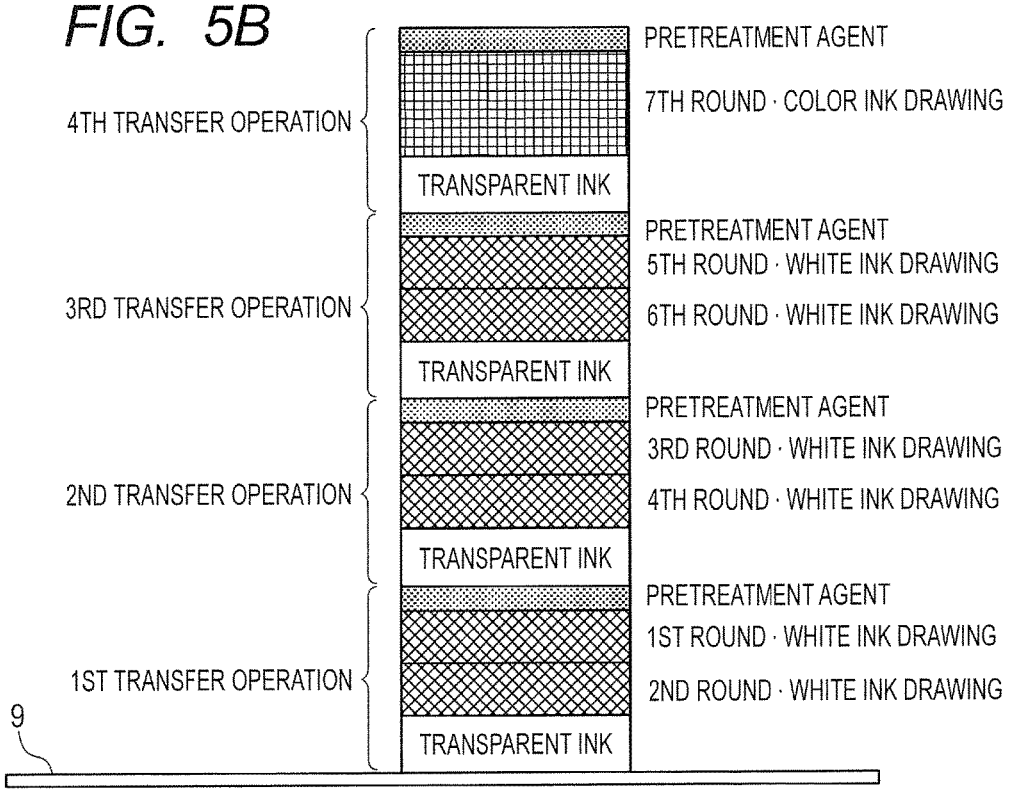

As illustrated in FIG. 5B, description will be given on a case where a color ink is overlaid on a white ink in an ink amount (600%) six times as large as a maximum ink amount (100%) of an ink that can be applied at one passage of an intermediate transfer member with respect to a location of the ink jet head 45.

In such a configuration, in general, the total of seven times of transfer operations, specifically six times of transfer operations using the white ink and one time of a transfer operation using the color ink, needs to be performed. This is because the white ink is ejected only from one ink jet head 45, and thus, even with ejection from all the nozzles (100% ink application), six transfer operations by the intermediate transfer member 2 are needed for transferring all the white ink. The intermediate transfer member 2, however, has a capacity of retaining the ink in an amount larger than the maximum application amount (100%) of the white ink described above. In this example, the intermediate transfer member has a capacity of retaining an applied ink amount of 300%.

Thus, in a case where the total amount of the applied white ink does not reach the ink retention capacity described above after application of the white ink, no transfer operation is performed, that is, non-execution is selected, and the transfer drum 1 is kept rotating in the same state. The pretreatment agent applying step is not executed, that is, non-execution of the pretreatment agent applying step is selected, and the ink jet head 45 is used again to apply a white ink onto the same portion of the intermediate transfer member 2 so that the current white ink covers the previous white ink. At the time when the total amount of the applied white ink reaches the maximum applied amount which is less than the ink retention capacity of the intermediate transfer member 2, a transfer operation is performed. In this manner, the total number of transfer operations can be reduced. To achieve this reduction, the following operation is performed.

Figure 2B:
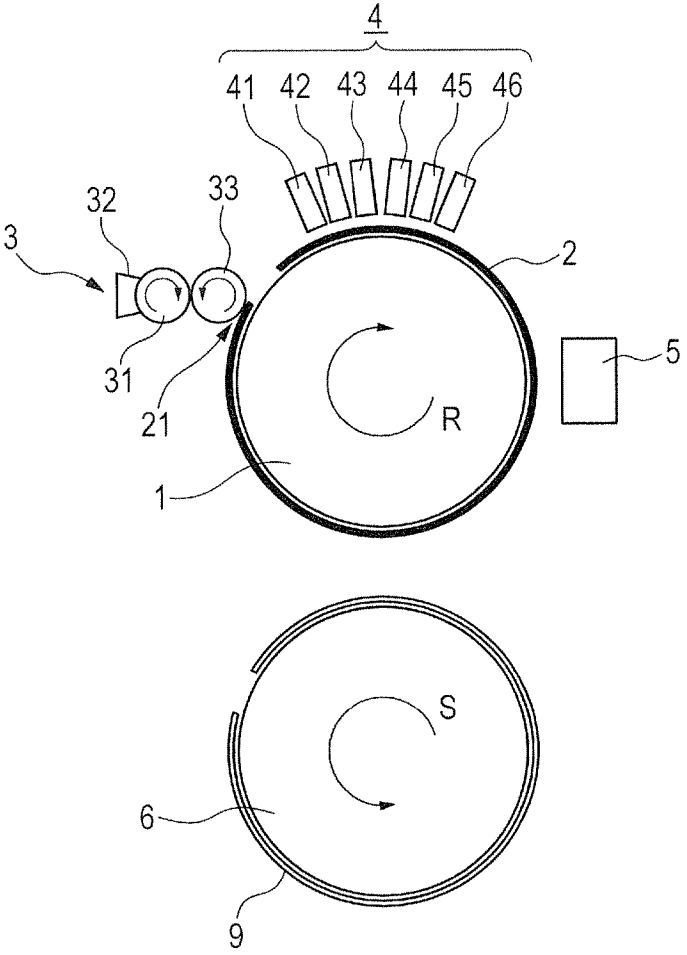
FIGS. 2A and 2B are schematic views illustrating a pretreatment agent applying step in an operation of the recording device using the ink jet recording method according to the present invention.
Figure 2A:
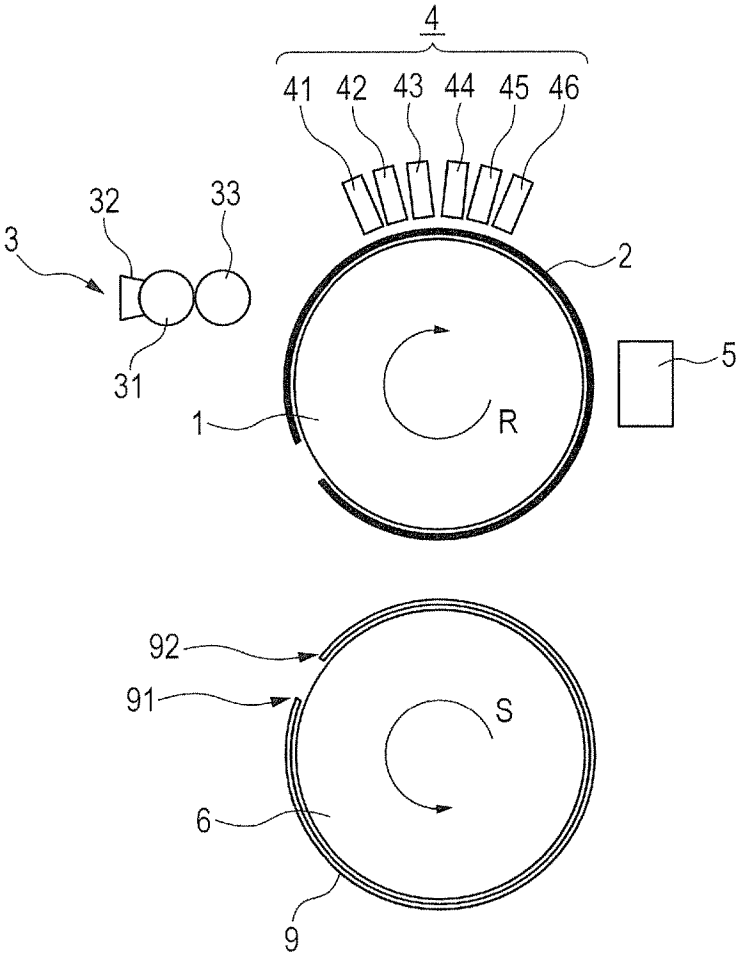

First, when an operation for recording an intermediate image is started the recording medium 9 is conveyed to the recording medium conveying drum 6 via the paper feed mechanism with the transfer drum 1 being alienated from the recording medium conveying drum 6, and then is fixed around the recording medium conveying drum 6 by a holding mechanism. Here, as a recording medium, coated paper for printing, "Aurora Coat" (manufactured by Nippon Paper Industries Co., Ltd.) was used. Then, as illustrated in FIG. 2A, the pretreatment agent applying unit 3 and the recording medium conveying drum 6 are alienated from the transfer drum 1. Thereafter, the transfer drum 1 starts rotating in the direction indicated by the arrow R, and the recording medium conveying drum 6 starts rotating in the direction indicated by the arrow S. With the rotation of the transfer drum 1, as illustrated in FIG. 2B, when the leading portion 21 of the intermediate transfer member 2 approaches the pretreatment agent applying unit 3, the alienated pretreatment agent applying unit 3 abuts on the intermediate transfer member 2 so that coating of the intermediate transfer member 2 with the pretreatment agent starts.

Figure 3B:
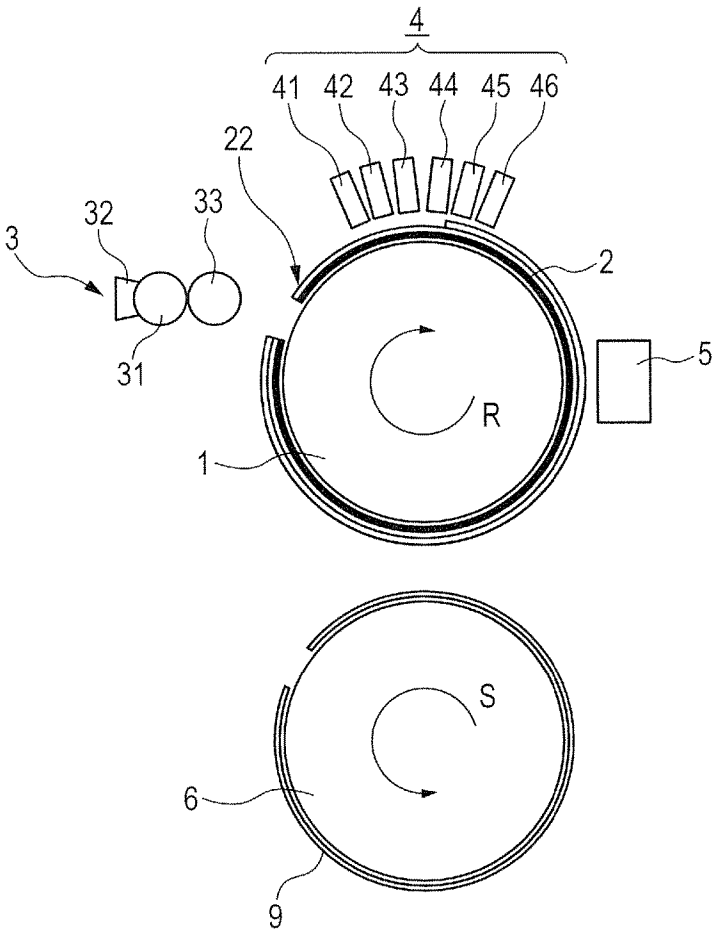
FIGS. 3A and 3B are schematic views illustrating formation of an intermediate image and a transfer operation in an operation of the recording device using the ink jet recording method according to the present invention.
Figure 3A:
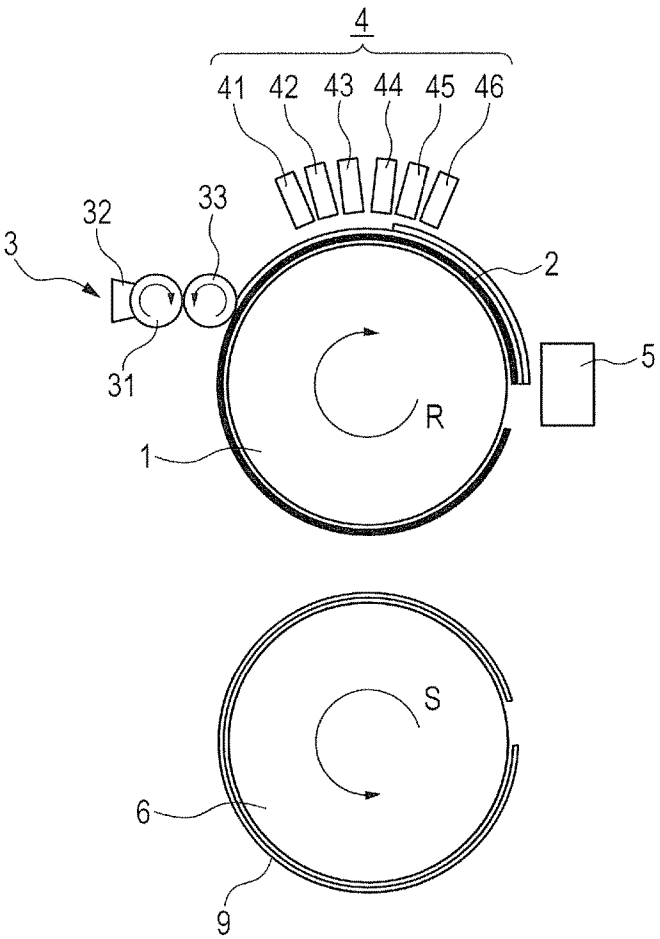

The transfer drum 1 further rotates and, as illustrated in FIG. 3A, 100% application of the white ink from the ink jet head 45 is performed, and then, moisture drying is performed on the white ink on the intermediate transfer member 2 by the hot air dryer 5. Since the intermediate transfer member 2 used here has a capacity of retaining up to 300% of the ink, the amount of the white ink applied so far does not reach the upper limit of the retention capacity of the intermediate transfer member. Thus, a larger amount of the white ink can be retained on the intermediate transfer member 2. Accordingly, while the pretreatment agent applying unit 3 and the recording medium conveying drum 6 are kept at the same positions, the transfer drum 1 and the recording medium conveying drum 6 further rotate. Since the recording medium conveying drum 6 is already alienated, even when the ink drawing part of the intermediate transfer member 2 proceeds to a location opposing the recording medium conveying drum 6, the retained white ink is not transferred onto the recording medium 9, and the transfer drum 1 continues to rotate in this state.

Thereafter, the transfer drum 1 and the recording medium conveying drum 6 continue to rotate. As illustrated in FIG. 3B, when a rear end 22 of the intermediate transfer member 2 passes over the pretreatment agent applying unit 3, the intermediate transfer member 2 moves for the distance corresponding to one round. The pretreatment agent does not need to be overlaid on the same portion of the intermediate transfer member 2 anymore, and thus, the pretreatment agent applying unit 3 is alienated from the intermediate transfer member 2.

When the transfer drum 1 and the recording medium conveying drum 6 further rotate, a portion of the intermediate transfer member 2 onto which the white ink has been already applied reaches a location under the ink jet head 45. Thus, at this time, 100% ejection of the white ink is performed again so that the amount of the applied white ink is 200%. In addition, the amount of 100% application of the transparent ink applied from the ink jet head 46 is set equal to the amount of 100% application of the white ink. Accordingly, when the 100% application of the transparent ink is performed onto the layer of the white ink by the ink jet head 46, the total amount of the ink applied until this time becomes 300%. Here, the transparent ink is applied in order to enhance adhesion between the intermediate image on the intermediate transfer member 2 and the recording medium 9 upon transfer, and thus only needs to be applied only upon drawing immediately before a transfer operation. Thus, the transparent ink is applied after application of the white ink is finished. Since the total ink amount on the intermediate transfer member 2 has reached 300%, a transfer operation is performed, that is, execution of a transfer operation is selected, when this portion of the intermediate transfer member 2 passes over the hot air dryer 5 and reaches a transfer region where the recording medium is disposed.

Figure 4B:
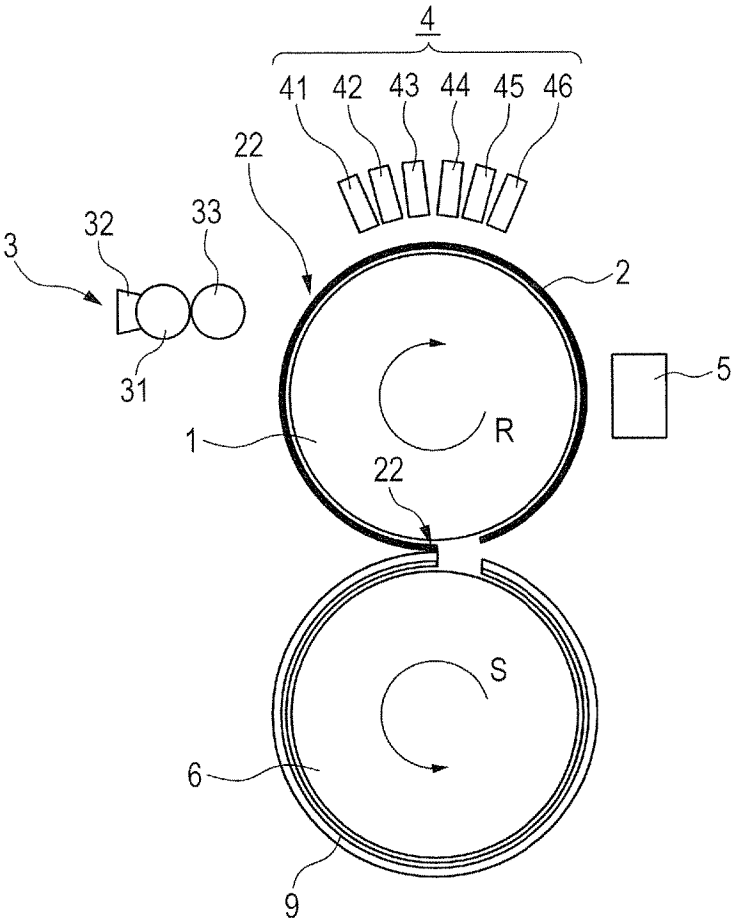
FIGS. 4A and 4B are schematic views illustrating a state in which a transfer operation is executed after ink application in an operation of the recording device using the ink jet recording method according to the present invention.
Figure 4A:
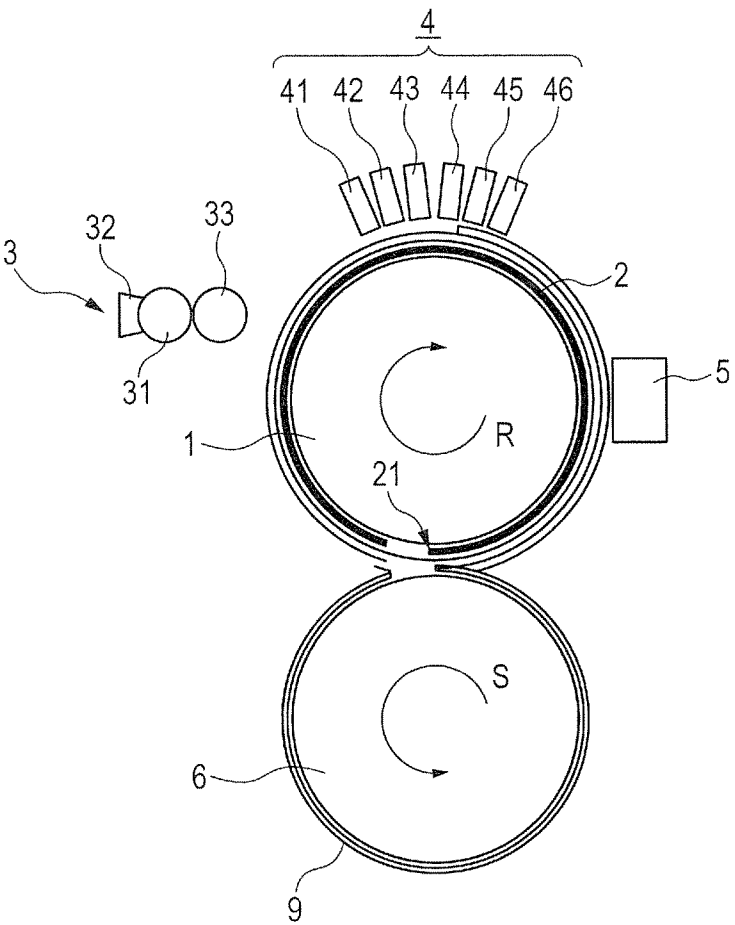

When the transfer drum 1 and the recording medium conveying drum 6 further rotate so that the leading portion 21 of the intermediate transfer member 2 reaches an abutting point with the recording medium conveying drum 6, as illustrated in FIG. 4A, the recording medium conveying drum 6 moves upward in the figure so that the recording medium 9 and the intermediate transfer member 2 are allowed to be in contact with each other. As a result, transfer of the white ink onto the recording medium 9 is started. As illustrated in FIG. 4B, this transfer operation continues until the rear end 22 of the intermediate transfer member 2 passes over the point of contact with the transfer drum 1 and the recording medium conveying drum 6.

In the foregoing operation, the intermediate image is transferred in the direction indicated by the arrow in FIG. 5A, transfer of two layers of the white ink close to the recording medium illustrated in FIG. 5B, that is, a transfer operation indicated as "1st transfer operation" in FIGS. 5A and 5B, is finished, and one transfer operation was performed on the recording medium 9 in two rotations of the transfer drum 1 so that a 200% amount of the white ink is transferred.

The step up to the "1st transfer operation" illustrated in FIG. 5A corresponds to the step set including (1) the pretreatment agent applying step to (4) the selection controlling step described above. In this example, a total of four step sets from the 1st transfer operation to a 4th transfer operation are executed.

Second and later transfer operations will now be described.

Following the "1st transfer operation," the transfer drum continues to rotate and similar operations are performed twice. In this manner, transfer operations indicated as "2nd transfer operation" and "3rd transfer operation" in FIG. 5B are finished.

With the 1st to 3rd transfer operations, 200% white ink is sequentially transferred onto recording medium 9 three times so that 600% white ink layers in total is formed on the recording medium 9. The intermediate transfer member 2 used here has a surface having no liquid permeability and a mold releasing property. Accordingly, after the transfer operation, neither the pretreatment agent nor ink components remain on the surface. Thus, the process starts with application of the pretreatment agent for next image formation.

Thereafter, the transfer drum 1 and the recording medium conveying drum 6 further rotate, and then, color inks are transferred. Here, an intermediate image using color inks of black, yellow, magenta, and cyan is formed by the ink jet heads 41 to 44 on the intermediate transfer member 2 onto which the pretreatment agent has been applied by the operations from FIG. 2B to FIG. 3A. Immediately after the formation of the intermediate image, 100% application of a transparent ink by the ink jet head 46 is performed. Since the image of color inks to be transferred have been already formed at this time, after passage over the hot air dryer 5, the process proceeds from the operation in FIG. 4A to the operation in FIG. 4B. Accordingly, the recording medium conveying drum 6 moves so that the recording medium 9 is allowed to abut on the intermediate transfer member 2. In this operation, a transfer operation indicated as "4th transfer operation" in FIG. 5B is finished, and a plurality of layers of color inks are formed on the recording medium 9 on which 600% white ink layers have been formed.

The ink layers illustrated in FIGS. 5A and 5B are transferred onto an image forming surface of the recording medium 9 to form a target final image and form solid layers of aggregate of liquid inks applied onto the intermediate transfer member. In this example, the white ink layer and the transparent ink layer are formed as a coating covering the entire image formation surface of the recording medium. The color ink layer has dots or has a line or a plane shape formed by combined dots in accordance with a target image. The white ink layer and the transparent ink layer may also be partially disposed on the image forming surface of the recording medium in accordance with a target image.

As described above, the inks are transferred onto the recording medium 9 and remain thereon as layered images formed by six layers of the white ink and the color inks. To obtain the image-transferred image, the transfer drum makes seven rotations, but the number of transfer operations is three.

As described above, in this example, the total amount of the white ink and the transparent ink necessary for forming a final image on the recording medium is divided among the first to fourth step sets in accordance with the ink retention capacity of the intermediate transfer member, and formation of an intermediate image on an intermediate transfer member and a transfer operation from the intermediate transfer member in each step set are performed. As a result, for an image that requires seven transfer operations in a conventional technique, the number of transfer operations can be reduced to four.

Control in performing alienation and abutting of each of the pretreatment agent applying unit 3 and the recording medium conveying drum 6 with respect to the intermediate transfer member 2 on the transfer drum 1 will now be described with reference to the flowchart of FIG. 7.

As described above, the amount of an applied ink is determined based on a printing image signal. Since the amount of the ink that can be retained on the intermediate transfer member 2 is up to 300% as described above, transfer onto the recording medium 9 is performed at the time when the ink amount reaches 300%. The remaining ink is used for next application onto the intermediate transfer member. A flow of these operations, that is, a flow of operations performed as execution or non-execution of a transfer operation, will be described with reference to the flowchart of FIG. 7.

When data corresponding to the amount of each applied ink is sent from a image signal, first, at step 811, rotations of the transfer drum 1 and the recording medium conveying drum 6 start, and the leading portion 21 of the intermediate transfer member 2 is initially detected at step 812. Here, a reflector of white paper is provided at the leading portion 21 of the intermediate transfer member 2 on the transfer drum 1, and this portion is detected by a photo reflector. In response to the detection signal, when the leading portion 21 reaches a location opposing to the pretreatment agent applying unit 3, the pretreatment agent applying unit 3 abuts on the intermediate transfer member 2 at step 813. With rotation of the transfer drum 1, the pretreatment agent is sequentially applied onto the surface of the intermediate transfer member 2.

With the rotation of the transfer drum 1, the process proceeds to step 814, and operations of drawing and drying of the applied ink are performed based on recorded data for each ink. After the end of the drawing (i.e., after passage over the locations of all the heads of the ink jet head group 4 in FIG. 1), the process proceeds to step 815, and it is determined whether there is an undrawn ink or not at this time. Here, if it is determined that there is "no" undrawn ink, the process proceeds to step 820, the recording medium conveying drum 6 abuts on the intermediate transfer member 2, and the process shifts to execution of a transfer operation. On the other hand, if it is not determined that there is "no" undrawn ink, the process proceeds to step 816. At step 816, it is determined whether the total amount of the ink already applied onto the intermediate transfer member exceeds a prescribed value, that is, a value corresponding to 300%, or not. If the total amount exceeds the prescribed value, an undrawn ink cannot be applied onto the intermediate transfer member, and thus, the process proceeds to a transfer operation at step 820. On the other hand, if the total amount of the ink applied onto the intermediate transfer member 2 is the prescribed value or less, the ink can be further applied, and thus, the process proceeds to step 817. At this step, it is necessary to prevent the intermediate transfer member 2 onto which the ink has been applied from coming into contact with the recording medium 9. Thus, the recording medium conveying drum 6 is alienated from the intermediate transfer member 2, and the process shifts to non-execution of the transfer operation. In addition, the process proceeds to step 818, it is determined whether the rear end 22 of the intermediate transfer member 2 reaches or not in the pretreatment agent applying unit 3. This detection can be performed in a manner similar to that of a detecting unit for the leading portion described above. At step 818, if the rear end 22 of the intermediate transfer member 2 is detected, it is determined that application of the pretreatment agent onto the entire region of the intermediate transfer member 2 is completed. In addition, the ink applied region of the intermediate transfer member 2 on which non-operation of a transfer operation is selected with rotation of the transfer drum 1 proceeds to a location opposing to the pretreatment agent applying unit 3. The pretreatment agent does not need to be applied onto this ink applied region of the intermediate transfer member 2, and thus, the pretreatment agent applying unit 3 is alienated from the transfer drum 1 at next step 819, and the process returns to step 814. On the other hand, at step 818, if the rear end 22 of the intermediate transfer member 2 is not detected, no change is needed for operations, and thus, the process returns to step 814 without change.

Figure 7:
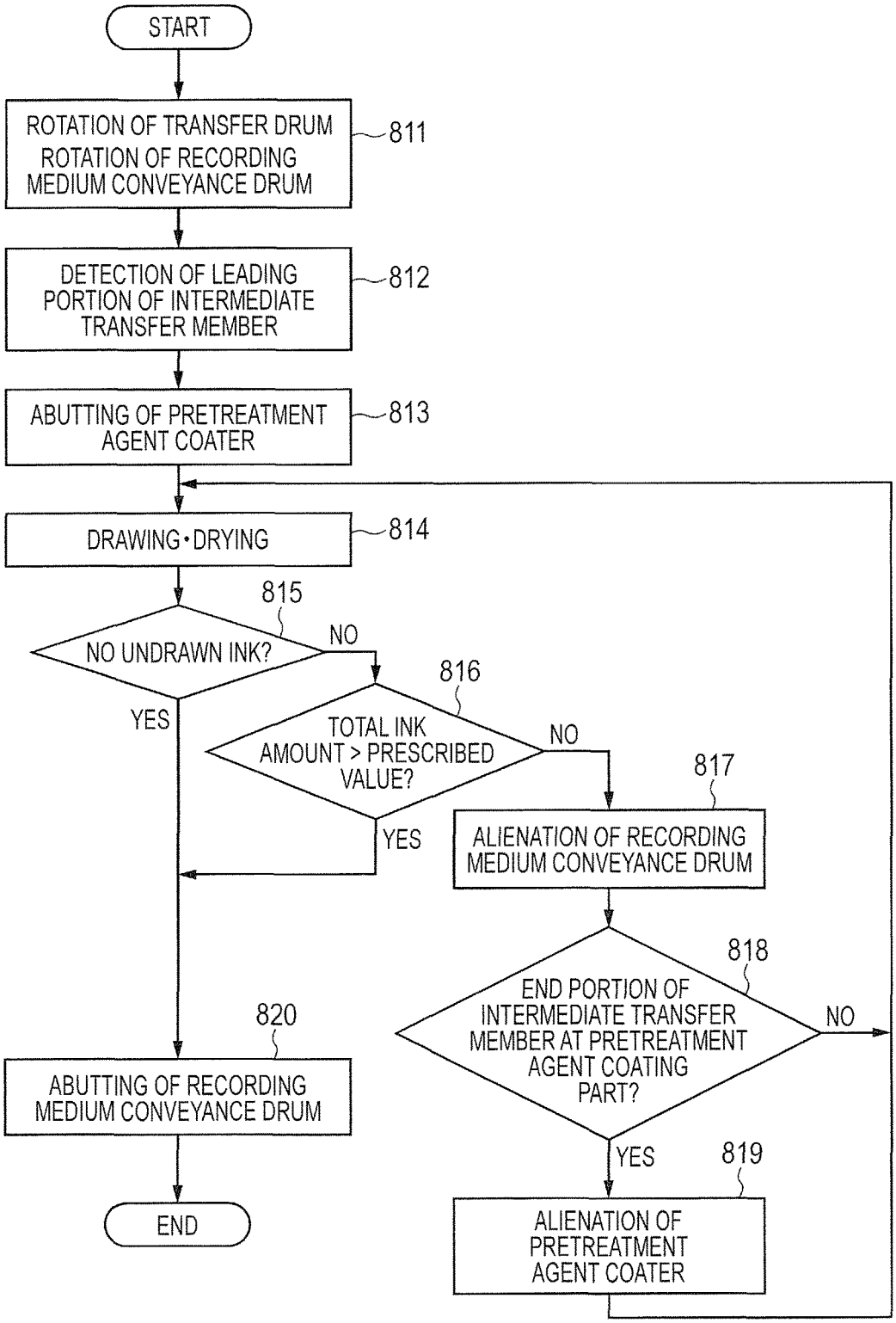
FIG. 7 is a flowchart of execution or non-execution of an operation of each component in a transfer operation.

The flowchart of FIG. 7 corresponds to the case of performing the step set including (1) the pretreatment agent applying step to (4) the selection controlling step. In the case of performing a plurality of step sets, after "end" of operations in the previous step set in FIG. 7, "start" of operations of the next step set is indicated.

Example 2

In Example 1, formation of an intermediate image on the intermediate transfer member 2 and transfer onto the recording medium 9 are performed for each of four intermediate images, and the four intermediate images are layered on the same portion of the image forming surface of the recording medium 9 so that a final image is formed. In other words, one intermediate image is formed on the intermediate transfer member 2 with one transfer operation.

In a case where intermediate images are small relative to the intermediate image forming surface of the intermediate transfer member 2, the intermediate image forming surface of the intermediate transfer member 2 is divided into different regions on each of which a corresponding one of the intermediate images is drawn, and then, the intermediate images are transferred onto the same portions of the recording medium 9. For example, in a case where the dimension of the transfer drum of the intermediate images in the moving direction is about 40% of the dimension of the transfer drum of the intermediate transfer member in the moving direction, the intermediate image forming surface on the intermediate transfer member 2 is divided into two regions, each of which can be used for forming an intermediate image.

Figure 8:
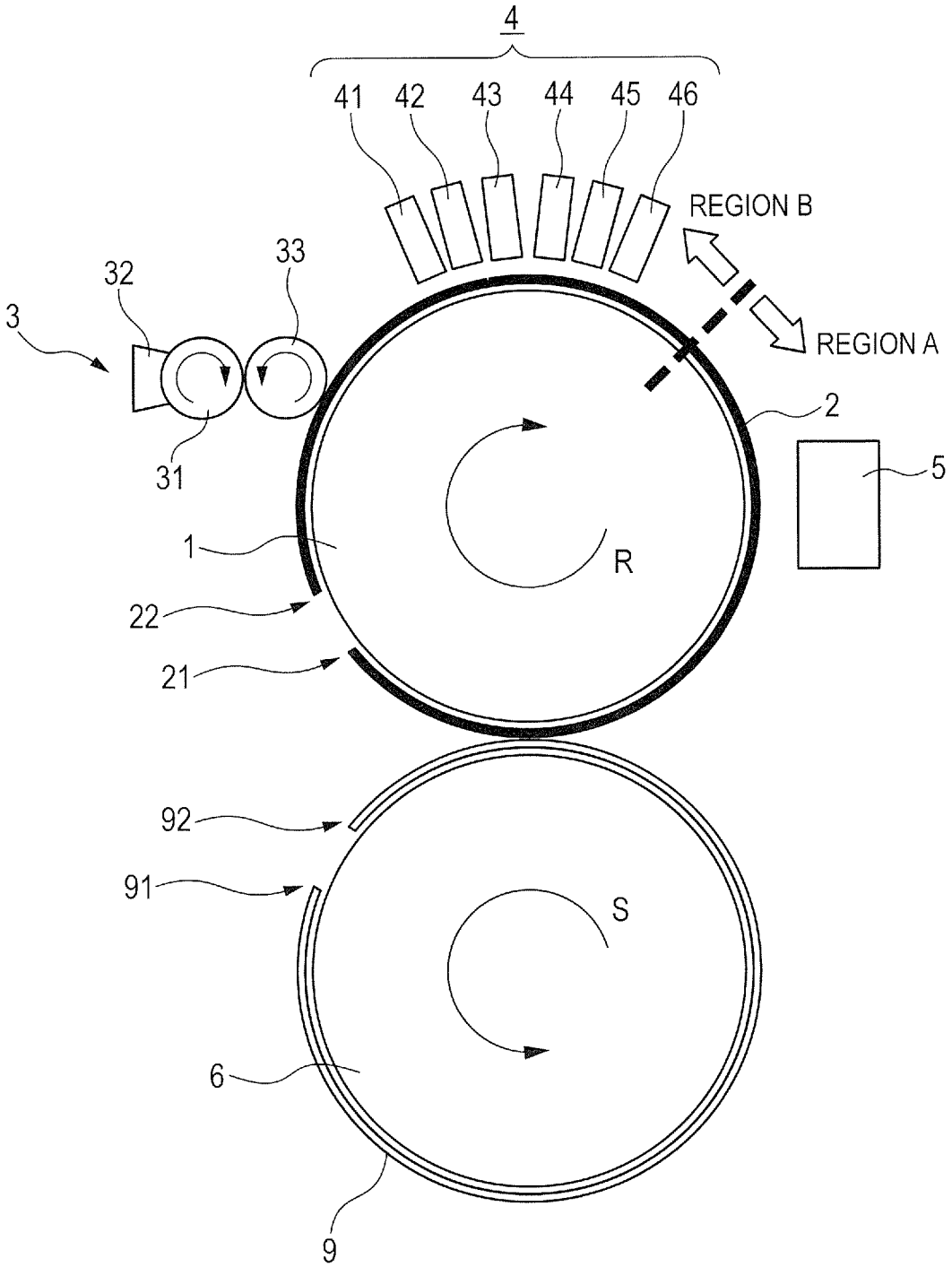
FIG. 8 illustrates that recording is performed by dividing a region of an intermediate transfer member.

Application of this method to layered transfer images illustrated in FIG. 5B can be achieved by the following operations. As illustrated in FIG. 8, the intermediate transfer member 2 is divided into two adjacent regions that face each other at a substantial center in the rotation direction (indicated by the arrow R) of the transfer drum 1. An upstream region in the rotation direction is defined as a region A, and the other region is defined as a regions B, for convenience of description. Here, an image to be printed has a size within each of these regions.

As for the operations, first, a pretreatment agent is applied onto the surface of the intermediate transfer member 2 by the pretreatment agent applying unit 3. Then, inks are sequentially applied onto the divided regions of the intermediate transfer member 2. At this time, "1st round white ink drawing" illustrated in FIGS. 5A and 5B is allocated to the 1st round region A, and "3rd round white ink drawing" is allocated to a 1st round region B. In this case, the location of the beginning of an image signal is at the leading portion 21 of the intermediate transfer member 2 in the case of drawing on the region A, and is at a boundary point between the region A and the regions B on the intermediate transfer member 2 in the case of drawing on the region B. After finishing these drawings, the amount of the applied ink is less than 300% on both regions, and thus, no transfer operation is executed anymore. Consequently, in a manner similar to that illustrated in FIG. 3A, the recording medium conveying drum 6 is alienated from the transfer drum 1.

Then, when the transfer drum 1 enters 2nd round rotation, since the pretreatment agent is already applied onto the intermediate transfer member 2, execution of the pretreatment agent applying unit 3 is not performed. In a manner similar to the previous 1st round rotation, "2nd round white ink drawing" illustrated in FIG. 5B is allocated to a 2nd round region A, and "4th round white ink drawing" is allocated to a 2nd round region B. In addition, at this 2nd round, together with drawing of the white ink, layer formation by drawing of the transparent ink is performed on each of the region A and the region B. The 1st and 2nd round drawings of the transfer drum 1 cause the total amount of the applied ink to reach 300% in each of the region A and the region B, and thus, a transfer operation is then executed so that these white inks are transferred onto the recording medium 9. Thus, in a manner similar to that illustrated in FIG. 4A, the recording medium conveying drum 6 abuts on the transfer drum 1. In the transfer operation in this case, an operation of the recording medium conveying drum 6 is controlled in the following manner.

Figure 9:
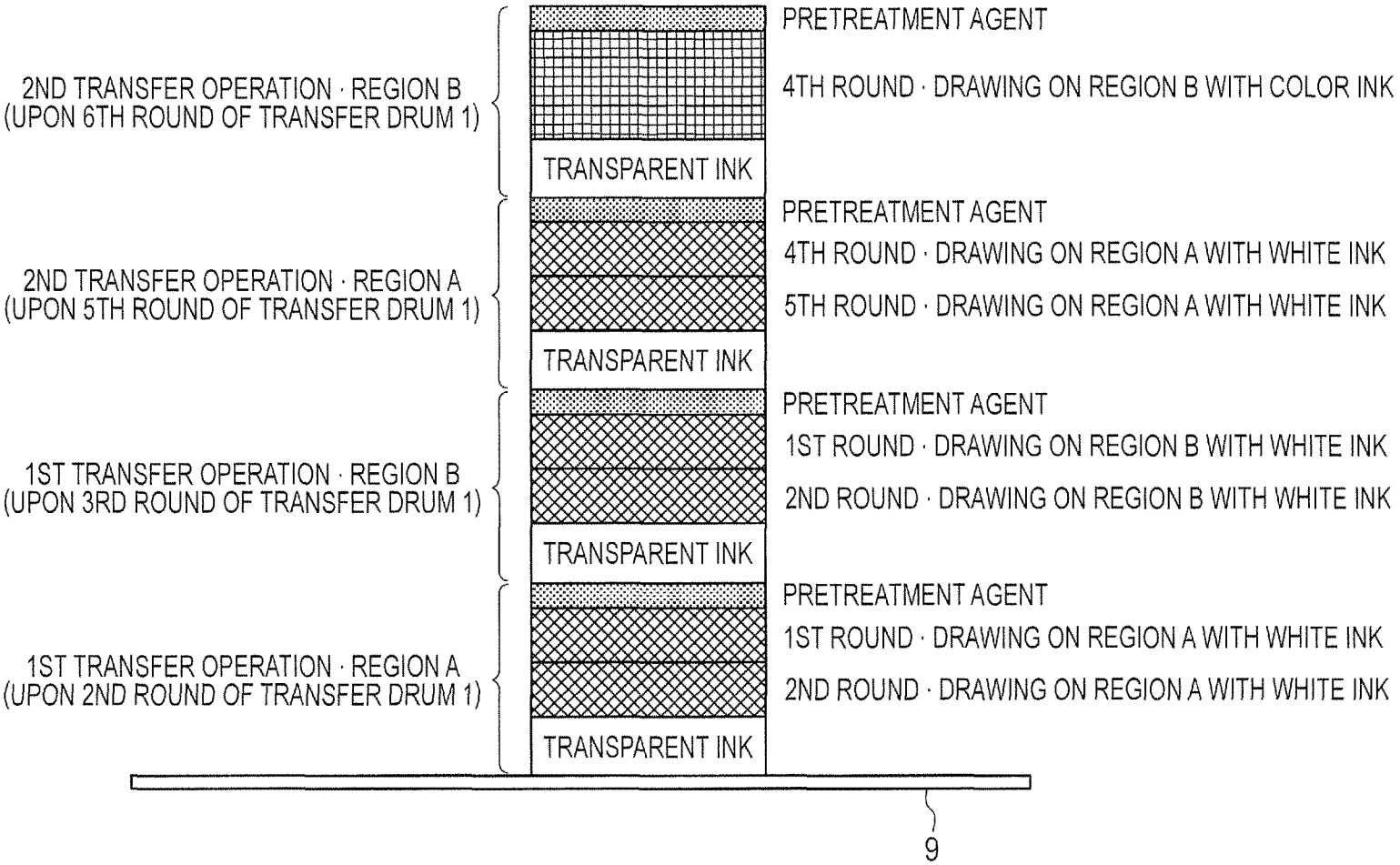
FIG. 9 illustrates a state of ink layers of an image formed on a recording medium and a transfer procedure when recording is performed by dividing a region of an intermediate transfer member.

In this transfer, a transfer operation on a portion corresponding to the region A is first performed, and when the boundary point between the region A and the region B reaches an abutting point between the transfer drum 1 and the recording medium conveying drum 6 in association with rotation of the transfer drum 1, the recording medium conveying drum 6 is alienated from the transfer drum 1. In this state, the rotation continues without change. Thereafter, the transfer drum 1 and the recording medium conveying drum 6 continue rotation, and when the holding part 91 of the recording medium conveying drum reaches a point corresponding to the abutting point between the transfer drum 1 and the recording medium conveying drum 6 again, rotation of the recording medium conveying drum 6 is temporarily stopped. Subsequently, with rotation of the transfer drum 1, at the time when the boundary point between the region A and the region B reaches the abutting point between the transfer drum 1 and the recording medium conveying drum 6, the recording medium conveying drum 6 abuts on the transfer drum 1 and rotation thereof restarts. At the restart of the rotation, the beginning location of drawing of the region B and the holding part 91 abut on each other. This operation causes an intermediate image drawn on the region B, that is, an image of white ink layers, can be transferred onto a portion of the recording medium 9 onto which an intermediate image on the region A has been already transferred. Through these operations, four layers of the white ink can be obtained by executing the 1st transfer operation, as illustrated in FIG. 9. In this case, although one transfer operation is performed on the entire intermediate transfer member 2, this transfer operation corresponding to two rotations of the transfer drum 1. This means that the transfer drum 1 finishes three rounds from the start of image recording.

In this operation, all of the pretreatment agent, the white ink, and the transparent ink on the intermediate transfer member 2 have been transferred onto the recording medium 9. Thus, in a subsequent 4th round operation of the transfer drum 1, the process starts with execution of the pretreatment agent applying unit 3. Thereafter, "5th round white ink drawing" illustrated in FIG. 5B is allocated to a 4th round region A, and "7th round color ink drawing" is allocated to a 4th region B. After finishing these drawings, the amount of the applied ink is less than 300% on both the regions, and thus, no transfer operation is executed anymore. Then, when the transfer drum 1 enters 5th round rotation, since the pretreatment agent has been already applied, execution of the pretreatment agent applying unit 3 is not performed. In a manner similar to the previous 4th round, "6th round white ink drawing" and "transparent ink" illustrated in FIG. 5B are allocated to a 5th round region A, and a layer of "transparent ink" on the color ink is allocated to a 5th round region B. The 4th and 5th round drawings of the transfer drum 1 cause the total amount of the applied ink to reach 300% or more in each of the region A and the region B, and thus, a transfer operation is then executed in a manner similar to the 1st transfer operation described above. In this manner, the fifth and sixth layers of the white ink and the layer of the color ink illustrated in FIG. 9 can be obtained by executing the 2nd transfer operation.

In this example, the intermediate images are small relative to the size of the intermediate image forming surface of the intermediate transfer member, and thus, even for the layers as those illustrated in FIG. 5B, the number of transfer operations can be reduced. Since a transfer operation is continuously performed on both of the region A and the region B, a pressure in a transfer operation is evenly applied to the entire region of the intermediate transfer member 2 even when changing in the amount of the applied ink. Thus, degradation due to a pressure of the intermediate transfer member 2 is not caused unevenly in a plane.

With this method, if an image is smaller, the number of divided regions of the intermediate transfer member 2 can be increased. At this time, to uniformize a transfer pressure to the entire intermediate transfer member 2, the divided regions preferably have substantially the same area.

Example 3

To enhance added values of a printed image, a technique of three-dimensional expression in which the amount of the applied ink is partially increased in the printed image to create local relief is often employed. This technique is frequently performed at a portion with no color. If the outermost surface of this portion is glossy, the three-dimensional expression can be more emphasized.

Figure 10:
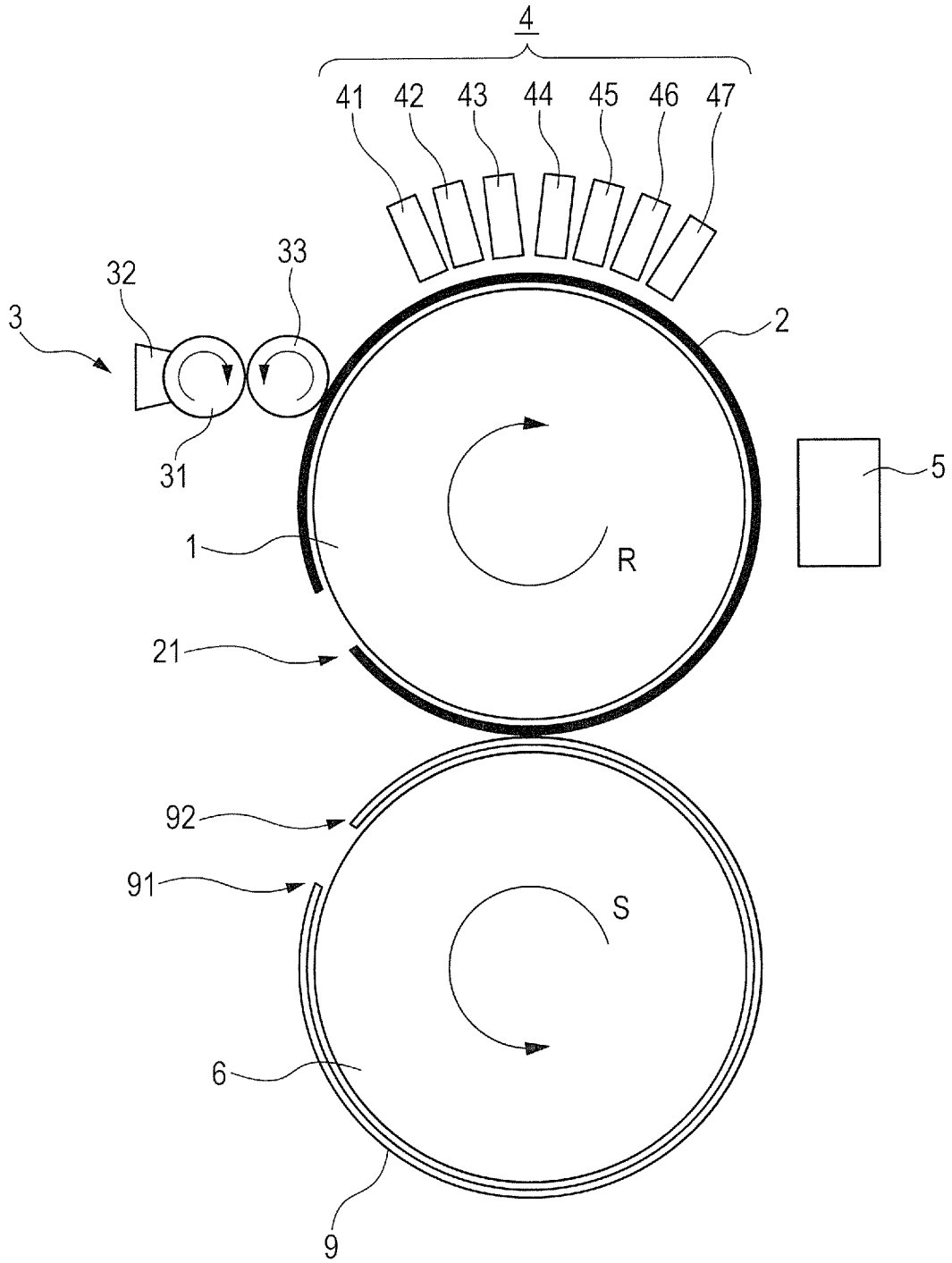
FIG. 10 is a schematic view illustrating an example in which a pretreatment agent applying step and a transfer step are always executed.

In the case of using this three-dimensional ink application with the recording device according to the present invention, the ink application can be performed in the following manner. In performing the ink application, as illustrated in FIG. 10, an ink jet head 47 is added to the ink jet head group 4. The ink jet head 46 and the ink jet head 47 are configured to eject two types of transparent inks, that is, a transparent ink 1 and a transparent ink 2. Here, after being applied onto the intermediate transfer member 2, the transparent ink 1 forms a smooth coating to enhance glossiness of this portion. The transparent ink 2 is identical to the transparent ink used in Example 1.

To obtain a height substantially equal to that of a recording ink layer not using the color inks in Example 1 by using these two types of transparent inks to sufficiently enhance glossiness, layers of the transparent ink 1 and the transparent ink 2 are sequentially overlaid five times. This is because the configuration illustrated in FIG. 10 enables application of the transparent ink 1 by the ink jet head 46 and subsequent application of the transparent ink 2 by the ink jet head 47 to be performed in one rotation of the transfer drum 1 upon drawing. Thus, 200% ink application can be performed in one rotation of the transfer drum 1. If next layers of the transparent ink 1 and the transparent ink 2 are overlaid without performing a transfer operation, the ink amount exceeds 300%, which is the ink retention capacity of the intermediate transfer member 2. In view of this, a transfer operation needs to be performed at the time when the 200% application of is finished.

Figure 11:
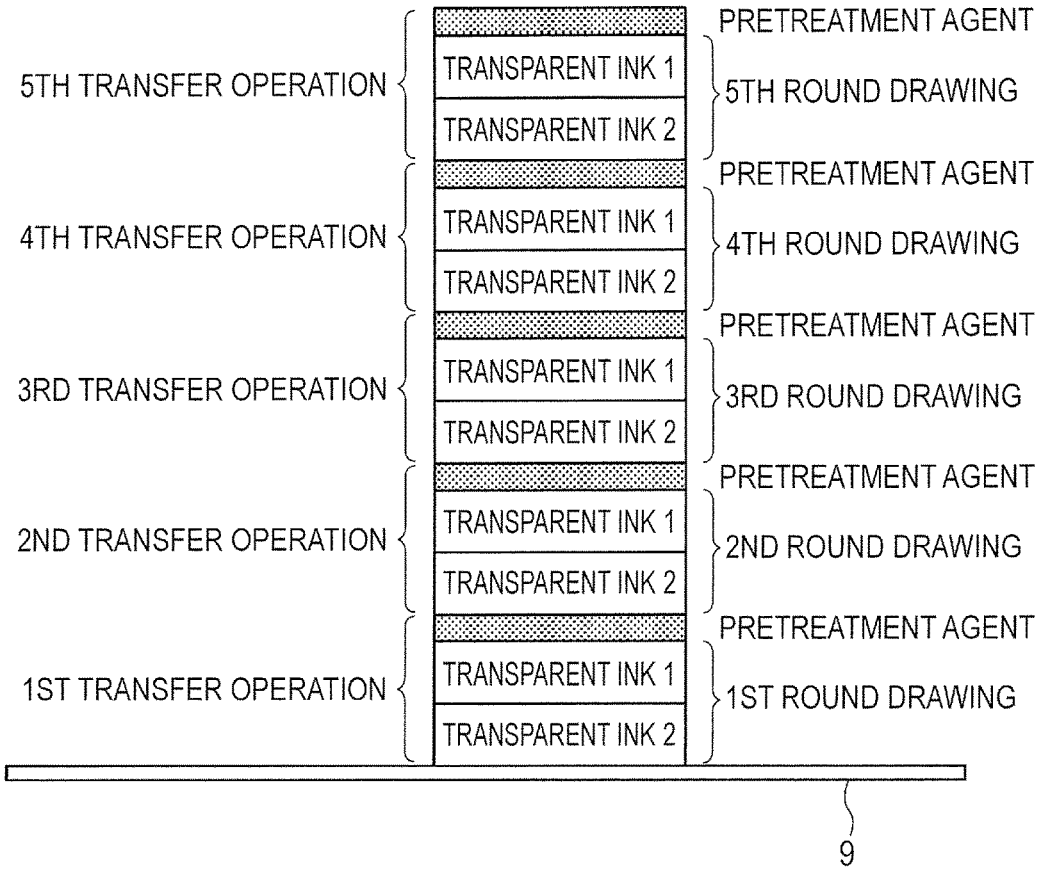
FIG. 11 illustrates a state of ink layers of an image formed on a recording medium by using the ink jet recording method according to the present invention.

As described above, the layer configuration of this example has a relationship between a transfer operation and a layer structure as illustrated in FIG. 11. In this case, a transfer operation is performed at every rotation of the transfer drum 1. Specifically, for a certain recording image, a recording mode in which selection of execution or non-execution of the transfer step is not controlled can be effective in some cases. Accordingly, in the recording method according to the present invention, it is also effective to have a recording mode in which the pretreatment agent applying step and the transfer step are always executed, in addition to a recording mode in which selection of execution or non-execution of each of the pretreatment agent applying step and the transfer step is controlled.

As compared to Example 1 in which image formation using only the white ink requires six rotations (six rounds) of the transfer drum 1, Example 3 needs five rotations of the transfer drum 1. Thus, Example 3 is advantageous for printing speed.

Example 4

In Example 1 above, after recording data for each head has been generated based on input image data and drawing has started, it is determined for each scanning whether the total ink amount reaches the prescribed value or not. For certain images to be recorded, however, it turned out before recording that the total ink amount does not reach a threshold in some cases. In this case, the total ink amount determination (step 816) illustrated in the flowchart of FIG. 7 is not needed. In other words, all the ink images on the intermediate transfer member can be transferred onto the recording medium and the transfer is finished by one transfer operation in some cases. In a case where a necessary amount of the white ink in FIG. 6B is small and can be obtained in a single layer, alienation control of the pretreatment agent applying unit 3 and the recording medium conveying drum 6 is not performed and a normal transfer operation is performed. Then, the transfer can be finished.

In consideration of such cases, a print mode in which the pretreatment agent applying unit 3 and the recording medium conveying drum 6 in the recording device may always abut on the transfer drum 1 may be added. Then, a print control time can be shortened. More specifically, the recording device has two modes: a print mode of selecting execution or non-execution of each operation of the pretreatment agent applying unit 3 and the recording medium conveying drum 6; and a print mode of always selecting execution of each operation of the pretreatment agent applying unit 3 and the recording medium conveying drum 6. The selection of these two print modes is performed after generation of the recording signal in FIGS. 6A and 6B.

Example 5

The applied amounts of a white ink and a transparent ink are larger than that of a color ink in many cases. In a case where heads having the same specification as that for the color ink are used to eject the white ink and the transparent ink, the transfer drum 1 needs to rotate many times in order to retain a prescribed amount of an ink on the intermediate transfer member. Thus, it is effective to increase the amount of an ink applied by one passage of the intermediate transfer member over the location of the ink jet heads for ejecting these inks. In a manner similar to the ink jet head for the transparent ink in Example 3, addition of the ink jet head for a white ink can be effective for increasing the ink amount, and similarly, the ink jet head for the transparent ink can also be added. In addition, as effective methods, the amount of one droplet to be ejected from the ink jet head for the white ink and/or the ink jet head for the transparent ink may be larger than that of the color ink, and the driving frequencies of these ink jet heads may be higher than that for the color ink. The use of these methods can shorten the recording time and reduce the number of transfers.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-138672, filed Jul. 10, 2015, which is hereby incorporated by reference herein in its entirety.

What is claimed is:

1. An ink jet recording method of transferring onto a recording medium an intermediate image formed on an intermediate transfer member by an ink jet technique to record an image on the recording medium, the method comprising:

(1) a pretreatment agent applying step of applying a pretreatment agent onto an intermediate transfer member;

(2) an ink applying step of applying an ink by an ink jet technique onto a region of the intermediate transfer member onto which the pretreatment agent is applied, thereby forming an intermediate image;

(3) a transfer step of transferring the intermediate image formed on the intermediate transfer member onto a recording medium; and (4) a selection controlling step of controlling selection of execution or non-execution of at least one of the pretreatment agent applying step and the transfer step, based on an amount of the ink applied onto the intermediate transfer member.

2. The ink jet recording method according to claim 1, wherein when the transfer step is not executed, the pretreatment agent applying step is not executed and the ink applying step is executed again.

3. The ink jet recording method according to claim 1, wherein the transfer step is not executed until a total amount of the ink applied onto the intermediate transfer member reaches a prescribed value.

4. The ink jet recording method according to claim 1, wherein a total amount of the ink is obtained from an ejected amount of the ink calculated from image data.

5. The ink jet recording method according to claim 1, wherein the method has a first recording mode of executing the pretreatment agent applying step and the transfer step and a second recording mode of controlling selection of execution or non-execution of each of the pretreatment agent applying step and the transfer step.

6. The ink jet recording method according to claim 1, wherein a step set including the steps (1) to (4) is performed multiple times, and intermediate images obtained in the step sets are sequentially transferred onto an identical image forming surface of the recording medium to form a final image.

7. The ink jet recording method according to claim 6, wherein the step sets are individually performed on different regions of the intermediate transfer member, and the different regions are substantially evenly disposed on the intermediate transfer member.

8. The ink jet recording method according to claim 6, wherein the ink comprises a white ink, a transparent ink, and a color ink of a color except white, the white ink and the transparent ink are allocated to the step sets in such a manner that an amount of application of each of the white ink and the transparent ink is larger than that of the color ink, and when forming an intermediate image including the color ink on the intermediate transfer member and transferring the intermediate image onto the recording medium, a total amount of the ink upon formation of the intermediate image including the color ink is less than the prescribed value.

9. The ink jet recording method according to claim 8, wherein an amount of one ejection droplet when applying at least one of the white ink or the transparent ink onto the intermediate transfer member is larger than that of the color ink.

10. The ink jet recording method according to claim 9, wherein an ejection frequency of an ink jet head for applying at least one of the white ink and the transparent ink onto the intermediate transfer member is higher than an ejection frequency of an ink jet head for applying the color ink.

11. The ink jet recording method according to claim 9, wherein the number of ink jet heads for at least one of the white ink and the transparent ink is larger than the number of ink jet heads for the color ink.

* * * * *